United States Patent [19]

Bowser et al.

[11] Patent Number: 4,952,430

[45] Date of Patent: Aug. 28, 1990

[54] INSULATED WINDOW UNITS

[75] Inventors: George H. Bowser, New Kensington; Stanley J. Pyzewski, Cheswick, both of Pa.

[73] Assignee: PPG Industries, Inc., Pittsburgh, Pa.

[21] Appl. No.: 238,019

[22] Filed: Aug. 29, 1988

Related U.S. Application Data

[63] Continuation-in-part of Ser. No. 129,399, Nov. 25, 1987, abandoned, which is a continuation of Ser. No. 49,004, May 7, 1987, abandoned, which is a continuation of Ser. No. 734,721, May 16, 1985.

[51] Int. Cl.[5] ..... E06B 3/24

[52] U.S. Cl. ..... 428/34; 428/192; 428/432; 52/788; 52/792

[58] Field of Search ..... 423/34, 192, 432, 332, 423/433; 156/107, 109; 52/671, 172, 788, 789, 796; 98/90

[56] References Cited

U.S. PATENT DOCUMENTS

| | | | |
|---|---|---|---|
| 1,045,617 | 11/1912 | Schafer . | |
| 1,998,671 | 4/1935 | Hadjisky | 20/56.5 |
| 2,189,465 | 2/1940 | Haley et al. | 20/40.5 |
| 2,202,694 | 5/1940 | Haux | 20/56.5 |
| 2,207,745 | 7/1940 | Lipsett | 20/56.5 |
| 2,278,694 | 4/1942 | Firner | 20/56.5 |
| 2,306,327 | 12/1942 | Baldwin et al. | 20/56.5 |
| 2,345,643 | 4/1944 | Verhagen | 20/56.5 |
| 2,597,097 | 5/1952 | Haven | 40/56.5 |
| 2,684,266 | 7/1954 | Englehart | 299/24 |
| 2,838,809 | 6/1958 | Zeolla et al. | 20/56.5 |
| 2,838,810 | 6/1958 | Englehart et al. | 20/56.5 |
| 2,964,809 | 12/1960 | Gwyn et al. | 20/56.5 |
| 3,001,248 | 9/1961 | Verhagen et al. | 20/56.5 |
| 3,034,416 | 5/1962 | Powell | 98/88 |
| 3,107,177 | 10/1963 | Saunders et al. | 117/211 |
| 3,280,523 | 10/1966 | Stroud et al. | 52/172 |
| 3,609,293 | 9/1971 | Stewart et al. | 219/200 |
| 3,669,785 | 6/1972 | Bowser et al. | 156/109 |
| 3,733,237 | 5/1973 | Wolff | 156/468 |
| 3,771,276 | 11/1973 | Stewart et al. | 52/172 |
| 3,791,910 | 2/1974 | Bowser | 161/45 |
| 3,919,023 | 11/1975 | Bowser et al. | 156/107 |
| 3,932,971 | 1/1976 | Day | 52/171 |
| 4,000,593 | 1/1977 | Cypher | 52/172 |
| 4,091,156 | 5/1978 | Edge et al. | 428/192 |
| 4,109,431 | 8/1978 | Mazzoni et al. | 52/172 |
| 4,198,254 | 4/1980 | Laroche et al. | 156/107 |
| 4,205,104 | 5/1980 | | |
| 4,215,164 | 7/1980 | Bowser | 428/34 |
| 4,222,213 | 9/1980 | Kessler | 52/790 |
| 4,226,063 | 10/1980 | Chenel | 52/172 |
| 4,335,166 | 6/1982 | Lizardo | 428/34 |
| 4,348,435 | 9/1982 | Mistrick et al. | 428/34 |
| 4,455,796 | 1/1984 | Schoofs | 52/172 |
| 4,545,160 | 10/1985 | Grether et al. | 52/172 |
| 4,627,206 | 12/1986 | Cox | 52/302 |
| 4,687,687 | 8/1987 | Terneu | 428/34 |

FOREIGN PATENT DOCUMENTS

| | | | |
|---|---|---|---|
| 28038/77 | 8/1977 | Australia . | |
| 33941/78 | 1/1980 | Australia . | |
| 2044832A | 4/1979 | European Pat. Off. . | |
| 3126901A | 2/1983 | Fed. Rep. of Germany . | |
| 1108188 | 1/1956 | France | 296//// |
| 0105524 | 9/1978 | Japan . | |
| 82/03652 | 10/1982 | PCT Int'l Appl. . | |
| 385466 | 9/1964 | Switzerland . | |

OTHER PUBLICATIONS

Pella Wood Clad Windows and Sliding Glass Doors, Pella Residential/Light Construction Catalog, pp. 1–43.

*Primary Examiner*—Ellis P. Robinson
*Assistant Examiner*—Donald J. Loney
*Attorney, Agent, or Firm*—Donald C. Lepiane

[57] ABSTRACT

A multiple-glazed window unit comprises a pair of glass sheets held in spaced relation to each other by a spacer and sealant assembly defining a sealed, insulating airspace between the sheets. The surface of the sheets facing the airspace has a protective surface. The spacer and sealant assembly is free of any desiccant. If desired, an opening may be provided through the spacer and sealant assembly to put the airspace in communication with the atmosphere external to the unit. In the stance where opposed openings are provided, and sized and configured to allow free movement of atmospheric air and water vapor molecules through the airspace to equalize airspace pressure and relative humidity with that of the external atmosphere, the protective surface is not needed. A filtering element is employed to minimize infiltration of liquid water, dust, dirt, and the like through the openings and into the airspace. The unit also comprises a sash retaining the unit within a structural opening. The protective coating on the interior surface of the glass sheets and the openings provided a multiple-glazed unit that does not have a desiccant material and has the interior surfaces free of haze.

19 Claims, 2 Drawing Sheets

INSULATED WINDOW UNITS

RELATED APPLICATION

This application is a continuation-in-part of application Ser. No. 129,399, filed Nov. 25, 1987, which is a continuation of application Ser. No. 49,004, filed May 7, 1987, now abandoned, which is a continuation of application Ser. No. 734,721, filed May 16, 1985, now abandoned.

FIELD OF THE INVENTION

The present invention relates generally to multiple-glazed window units and, more particularly, to multiple-glazed units having their insulating airspace in fluid communication with the atmosphere external to the unit, and to multiple-glazed units having protected glass surfaces facing their insulating airspaces.

BACKGROUND OF THE INVENTION

Multiple-glazed, insulating window units usually consist of two (or more) panes of glass maintained in spaced, parallel relation to each other by a spacing and sealing assembly which is structurally bonded to the marginal edge periphery of opposed, inner or facing surfaces of the glass panes to define a hermetically sealed, insulating airspace between the panes. The spacing and sealing assembly hermetically seals the airspace from the environment. The spacing and sealing assembly generally contains a desiccant material or dehydrator agent for adsorbing moisture or water vapor which may be present in the airspace when the units are assembled or which may later diffuse through the sealant of the spacing and sealing assembly to ensure dryness of the airspace, to prolong the useful life of the unit, and to enhance the performance quality thereof. Representative examples of multiple-glazed, insulating window units are taught in U.S. Pat. Nos. 2,306,327; 2,838,810; 3,280,523; 3,733,237; 3,791,910; 4,226,063 and 4,348,435, which teachings are herein incorporated by reference.

When the sealed, insulating window units of the above-discussed type are subjected to pressure differential between the airspace and the exterior atmosphere, the pressure differential will result in deflection of the glass panes. Pressure differential may be caused in a multiplicity of ways, e.g. by the atmospheric pressure whereat the window unit is installed being different than the pressure conditions which existed when the unit was sealed and/or by large temperature differences between the airspace and the exterior atmosphere, e.g. during large atmospheric temperature changes. When the pressure between the panes is less than the exterior pressure, the panes are forced closer together. Conversely, when the pressure in the space exceeds the exterior pressure, the panes are forced apart. Appreciable deflection of the panes can cause optical distortion of the window unit and can also present an undesirable cosmetic effect. Further, appreciable deflection places stress on the spacing and sealing assembly which may weaken the adhesive bond between the glass surfaces and the spacing and sealing assembly and ultimately cause a separation therebetween. This phenomenon may result in leakage and infiltration of relatively moist exterior air into the insulating airspace, ultimately causing saturation and exhaustion of the desiccant contained by the spacer element. When the desiccant is exhausted, it is no longer capable of adsorbing the moisture-vapor present in the airspace, and condensation of the moisture-vapor begins to occur on the glass surfaces contacting the airspace hereinafter referred to as interior glass surfaces. More specifically, the moisture-vapor forms a molecular film of water on the interior glass surfaces. The molecular film absorbs or leaches molecules or ions from the glass surfaces. This leaching phenomenon is evident/is manifested as scum or stain on the interior glass surfaces, which imparts an undesirable white hazy or foggy appearance to the window unit. As can now be appreciated, the sealed insulating window units of the instant discussion are preferably used where pressure differentials are insufficient to cause a separation between the glass pane and spacing and sealing assembly.

Multiple-glazed window units of the type taught in U.S. Pat. Nos. 3,771,276; 3,838,809 and 4,455,796 minimize the above-discussed deflection and desiccant saturation problems by providing facilities to equalize the air pressure in the airspace to the ambient air pressure while keeping the airspace relatively free of moisture. In general, U.S. Pat. No. 3,771,276, assigned to the assignee of the present invention, teaches a multiple-glazed unit having a breather device comprised of a capillary tube connected to a column of desiccant, so that a free end of the capillary tube is disposed in open communication with the air surrounding the unit (i.e. the exterior atmosphere) while the desiccant column, to which the capillary tube is fluidly connected at its opposite end, is in communication with the enclosed, insulating airspace of the unit. In operation, the breather unit works in the following manner. When the exterior atmospheric pressure exceeds the air pressure of the insulating airspace, e.g. due to a nighttime temperature drop, air flows from the exterior atmosphere, through the capillary tube and the desiccant column, and thenceforth, into the insulating airspace. During this inflow of the exterior atmospheric air, moisture contained in the entering air is adsorbed by the desiccant. Further, the airspace pressure and the exterior atmospheric pressure are equalized, thereby preventing deflection of the opposed glass panes. Conversely, when the air pressure of the insulating airspace exceeds the pressure of the exterior atmospheric air, e.g. due to warmed air expansion during daytime hours, then air flows from the insulating airspace, through the desiccant column and the capillary tube, and thenceforth, into the exterior atmosphere. The warm, outflowing air desorbs the previously adsorbed moisture from the desiccant, thereby regenerating the desiccant and extending its useful life. Further, the airspace pressure and the exterior atmospheric pressure are equalized, thereby eliminating deflection of the glass panes. U.S. Pat. No. 4,455,796 issued to Schoofs teaches an insulating glass unit similar to that taught in U.S. Pat. No. 3,771,276 discussed above. In general, the unit of Schoofs has a breather device for minimizing deflection of the glass panes and maximizing the useful life of the desiccant. U.S. Pat. No. 2,838,809, assigned to the assignee of the present invention, in general, teaches a unit having a plurality of glass sheets separated at their marginal edges by a hollow spacer element containing a desiccant material, an elongated strip of mastic in sealing contact with the edges of the glass sheets and the spacer element, and a pressure sensitive tape covering the strip of mastic. The unit is provided with an aperture or aligned opening through the tape, mastic and outer wall of the spacer element to connect the atmosphere with the desiccant, and at least one other opening through the inner wall of the spacer element communicating with the insulating airspace of the unit. The aligned openings or apertures permit the unit to "breathe" through the desiccant material in response to changes in atmospheric conditions.

All of the above-discussed presently available insulating window units are acceptable in one or more applications; however, as can now be appreciated, not every unit is ideally suitable for every use. It would be advantageous therefore to provide a multiple-glazed window unit having features which make the unit less expensive to manufacture than the presently available units while eliminating the limitations of the presently available units.

SUMMARY OF THE INVENTION

One embodiment of the present invention includes a window unit having two (or more) sheets, e.g. glass panes, maintained in spaced relationship to each other by a spacing and sealing assembly bonded to the marginal edge periphery of the inner facing surfaces of the panes to form a hermetically sealed enclosure between the sheets. A plurality of openings are provided through the spacing and sealing assembly to put the airspace in direct communication with the atmosphere external to the unit to thereby allow the air pressure within the airspace and the air pressure of the external atmosphere to equalize. The pressure openings or breather holes are sized and configured to cooperatively function to enable free, unobstructed, unimpeded movement of outside air and water vapor molecules through the breather holes of one assembly portion, through the insulating airspace and thenceforth through the breather holes of the opposed assembly portion into the outside atmosphere. In this manner there is a continuous moisture-vapor transmission path from the outside atmosphere, through the insulating airspace, and back to the outside atmosphere to minimize haze formation within the airspace and to maintain haze level within the airspace below a threshold level of about 7% haze, preferably 4% haze, as measured with a Hunter Model D554 instrument, after the unit is subjected to about one week exposure at about 140° F. (60° C.), 90% relative humidity, in a controlled testing environment. A filtering medium preferably covers the breather holes to prevent the ingress or migration of dust, dirt, liquids, and other contaminants into the insulating airspace. The breather holes allow rapid equalization of the pressure of the atmosphere within the insulating airspace and the atmospheric pressure outside of the window unit, to prevent or minimize deflection or bowing of the glass panes. Further, the elimination of the desiccant or adsorbent material permits free circulation or movement of outside air and water vapor molecules into and out of the insulating airspace thereby minimizing the trapping of these molecules within the airspace and thereby minimizing condensation and/or moisture buildup within the airspace, even during periods of drastic or unusual changes of temperature and/or relative humidity conditions in the outside atmosphere. Eliminating the need for adsorbent material reduces the cost of the unit while minimizing deflection of the panes.

In another embodiment of the invention, the number of holes in the spacing and sealing assembly may be reduced by providing the interior glass surfaces with a protective surface to reduce if not eliminate the attack on the glass surface by water vapor which may cause a white haze or scum to form on the surface. The protective surface may be a pyrolytic tin oxide coating, e.g. of the type taught in U.S. Pat. No. 3,107,177, which teachings are hereby incorporated by reference, and/or sold by PPG Industries, Inc. under its Registered Trademark "NESA" or may be the "tin side" of glass sheets or panes cut from a float glass ribbon. More particular, as taught in U.S. Pat. No. 4,091,156, which teachings are hereby incorporated by reference, molten glass is deposited on a molten bath of tin or an alloy of tin. As the molten glass floats on the bath it is sized and coated to form a continuous glass ribbon. The side of the ribbon contacting the bath is usually referred to as the "tin side" and the opposite side of the ribbon is usually referred to as the "air side". In this embodiment of the invention the tin side of the glass panes face the insulating airspace.

In a further embodiment of the present invention, the units described above are mounted in a frame or sash. The sash, in general, has a glazing pocket or recess for receiving the marginal edges of the multiple-glazed window unit. Portions of the sash which correspond to the portions of the spacing and sealing assembly provided with the breather holes, are spaced from the outer surface of the corresponding portion of the spacing and sealing assemble, to form an air passageway channel or chamber therebetween. Holes are provided through the sash portions corresponding to the portions of the spacing and sealing assembly having the breather holes, to put the insulating airspace in communication with the atmosphere external to the window unit, via the air passageway channels, to thereby establish a continuous transmission path for free air and water vapor molecular flow through the insulating airspace.

In still another embodiment of the invention, the spacing and sealing assembly having no desiccant or breather holes maintains the glass panes in spaced relation and provides a sealed, insulated airspace therebetween. The surface of each of the glass panes facing the sealed, insulating airspace has a protective coating, as taught above.

DESCRIPTION OF THE INVENTION

The instant invention will be taught by discussing different designs of multiple-glazed units incorporating features of the invention. However, as will be appreciated, the invention is taught in this manner for a better appreciation of the invention but is not limiting to the invention. For example, the design features of one unit may be used with the features of another unit.

Multiple-Glazed Unit Design No. 1

Multiple-Glazed Unit Design No. 1, in general, relates to a multiple-glazed unit having an insulating airspace between a pair of glass sheets and openings or breather holes to move ambient air through the insulated airspace.

Figure 1:
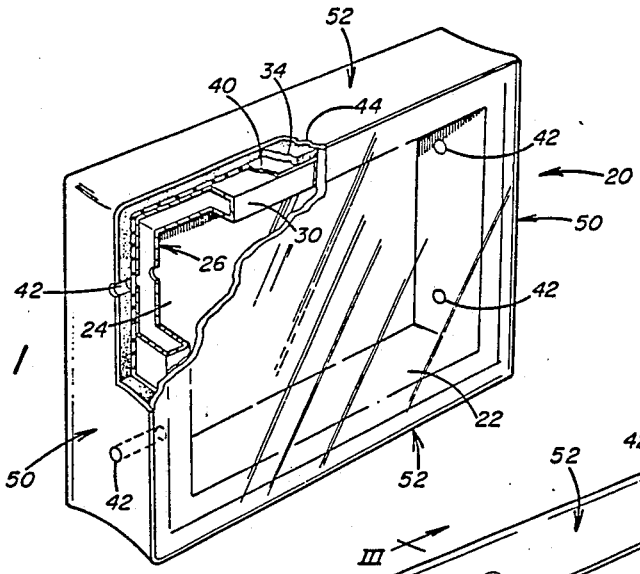
FIG. 1 is a perspective, partially cutaway view of a multiple-glazed window unit embodying features of one embodiment of the present invention.

With reference to FIG. 1, there is shown a multiple-glazed window unit 20 having a pair of panes or sheets 22, 24 maintained in spaced relation to each other by a spacer and sealant assembly 26 defining an insulating airspace 28 (see FIG. 3) between the sheets 22, 24. The type of sheets 22, 24 employed is not limiting to the invention. The sheets 22, 24 are transparent sheets made of, e.g., glass or plastic. However, either or both of the sheets 22, 24 may be rendered opaque by a suitable opacifier, e.g. such as taught in U.S. Pat. No. 4,000,593 issued to Cypher, which teachings are herein incorporated by reference, to provide a spandrel unit. Further, the sheets 22, 24 may have any desired optical, thermal, safety, aesthetic, or solar control properties. For example, either or both of the sheets 22, 24 may be tinted or colored glass, e.g. such as the glass sold by PPG Industries, Inc. under its registered trademarks SOLARBRONZE®, SOLARGRA®, OR SOLEX®. Yet further, either or both of the glass sheets 22, 24 may be laminated, heat strengthened, or tempered for safety or other purposes.

Figure 3:
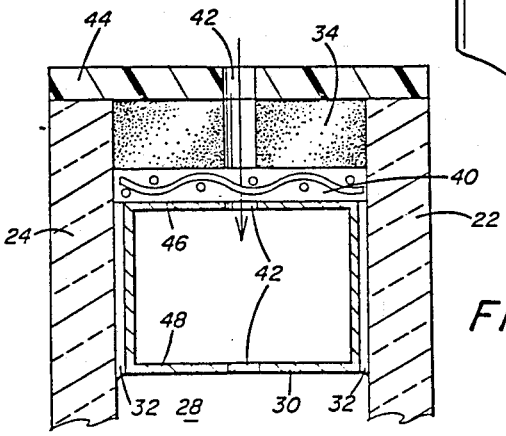
FIG. 3 is a fragmentary, cross-sectional view of the window unit of FIG. 2 taken along the line III—III in FIG. 2.

Referring still to FIG. 1 and additionally to FIG. 3, a preferred embodiment of the spacer and sealant assembly, a hollow, metal spacer 30 made of extruded aluminum, steel or any other suitable material, extending around the inner, marginal peripheries of the glass sheets 22, 24, to hold the sheets in a spaced relationship. The hollow, metal spacer may be of the type taught in U.S. Pat. Nos, 2,306,327; 2,838,810; 2,684,266; 3,280,523 and 3,919,023, all of which are assigned to the assignee of this invention, which teachings are all herein incorporated by reference. A moisture-resistant mastic layer 32, e.g. such as the type taught in U.S. Pat. No. 3,791,910 issued to Bowser, which teachings are herein incorporated by reference, adheres the spacer 30 to the glass sheets 22, 24, to thereby form the enclosed chamber or insulating airspace 28. In this embodiment, no desiccant or absorbent material is provided in the hollow interior of the spacer 30, thereby reducing the manufacturing costs and complexity. If a non-metal spacer such as the type taught in U.S. Pat. No. 3,669,785; 4,109,431 or 4,215,164, assigned to the assignee of the present invention, and in U.S. Pat. Nos. 4,198,254; 4,205,104 and 4,226,063, which teachings are also herein incorporated by reference, is employed, the desiccant material is left out of the polymeric matrix spacer composition, thereby eliminating the costs associated with adding it to the polymeric matrix.

With continued reference to FIG. 3, a fine mesh screen 40 made of any suitable material, e.g. a cloth, fabric, or stainless steel having an adhesive applied to at least one side thereof, is secured to the outer periphery of the spacer 30. The fine mesh screen 40 may suitably be a venting tape of the type sold by 3M Company. A ribbon or layer 34 of adhesive sealant material is preferably adhered to the outer periphery of the mesh screen 40 and the inner marginal peripheries of the glass sheets 22, 24. The outer, sealant layer 34 may suitably be of the type taught in U.S. Pat. Nos. 2,306,327; 3,791,910 or 4,348,435. The outer sealant layer 34 should form a resilient, firm, adhesive structural bond to maintain the desired spacing between the sheets 22, 24. The inner, mastic layer 32 and the spacer 30 preferably provide a primary seal and the outer, sealant layer 34 preferably provides a secondary seal, to maintain the position of the spacer and prevent slippage of glass in use. Also, the secondary seal maintains the hole relationship into the airspace 28 to minimize migration or penetration of moisture or water vapor into the insulating airspace 28 so that fluid communicates between the airspace 28 and the exterior of the unit is through the holes 42 in the manner discussed hereinbelow. A channel member (not shown), such as disclosed in U.S. Pat. Nos. 2,838,810; 2,964,809 and 3,280,523, may be affixed around the periphery of the unit 20 to protect the edge periphery of the sealant layer 34. Alternatively, as can be seen in FIG. 3, a durable material, e.g. polyethylene tape 44 is applied around the outer periphery of the sealant layer 34 and the peripheral edges of the glass sheets 22, 24 to protect the same.

Figure 2:
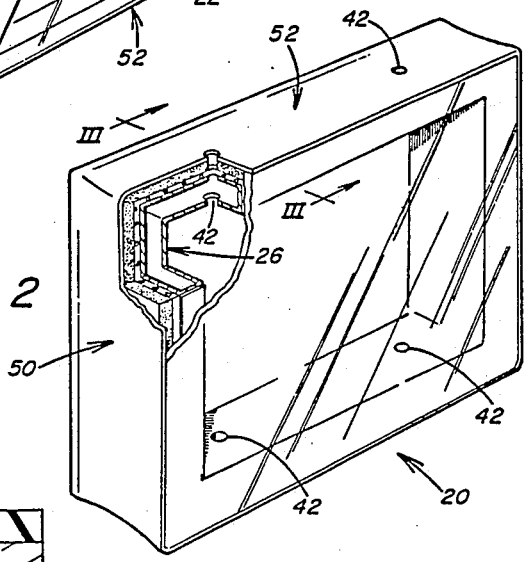
FIG. 2 is a perspective, partially cutaway view of a multiple-glazed window unit embodying features of another embodiment of the present invention.
Figure 4:
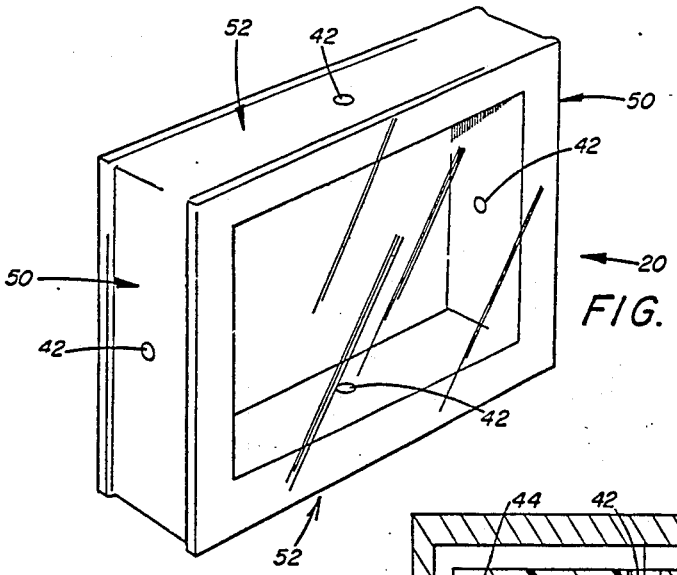
FIG. 4 is a perspective view of a multiple-glazed window unit embodying features of another embodiment of the present invention.

Aligned openings 42 are provided through the protective tape 44, the sealant layer 34, the venting tape 40, and the outer surface 46 and inner surface 48 of the spacer 30, to provide direct communication of the insulating airspace 28 with the ambient atmosphere surrounding the window unit 20. As shown in FIG. 1, the breather holes or openings 42 are located at opposite corner portions of the vertical legs 50 of the spacer and sealant assembly 26. Alternatively, referring now to FIG. 2, the breather holes 42 are located at opposite corner portions of the horizontal legs 52 of the spacer and sealant assembly 26. In another alternative embodiment of this invention, as can be seen in FIG. 4, the openings 42 comprise a breather hole 42 at a central portion, e.g. the midpoint, of each of the legs 50 and 52 of the spacer and sealant assembly 26.

As will be appreciated, the size, type, shape, location, and/or configuration of the openings 42 are not limiting to the present invention but are selected to prevent moisture condensation in the unit as discussed below. More particularly, the openings 42 may suitably be slits, slots, apertures, or holes of any shape, e.g. oval, circular, elliptical, triangular, rectangular, polygonal, etc. provided in the spacer and sealant assembly, e.g. the openings 42 may be slots (not shown) provided through the four corners of the spacer and sealant assembly 26.

The only criterion for the size, shape, and location of the openings 42 is that they collectively or cooperatively function to provide a direct moisture-vapor molecular transmission path from the ambient atmosphere, through the insulating airspace 28, and back to the ambient atmosphere. This free, circulatory flow or movement of water vapor molecules into and out of the airspace 28 prevents or minimizes condensation on the glass sheets 22, 24 by minimizing the trapping of these molecules within the airspace 28. Further, this free movement of air and water vapor molecules into and out of the airspace 28 enables rapid equalization of the pressure and relative humidity between the airspace 28 and the ambient atmosphere. Rapid equalization of the pressure in the airspace 28 with the pressure of the ambient atmosphere minimizes the edge stresses imposed on the spacer and sealant assembly 26 by deflection of the glass sheets 22, 24 due to pressure differences between the airspace 28 and the ambient atmosphere. Rapid equalization of the relative humidity in the airspace 28 with the relative humidity of the ambient atmosphere minimizes condensation in the airspace 28 due to fluctuations of atmospheric humidity conditions.

Although it is not clearly understood, it is believed, based on testing results of window units made in accordance with the teachings of this invention, that maximum free movement of air and water vapor molecules through the airspace 28 occurs when the breather holes 42 are located substantially directly opposite each other.

Multiple-Glazed Unit Design No. 2

Multiple-Glazed Unit Design No. 2, in general, relates to a multiple-glazed unit having a protective film (not shown) on interior glass surfaces of the glass sheets 22 and 24 respectively facing the airspace 28. The surfaces 41 and 43 may be provided with a coating, e.g. a pyrolytic tin oxide coating of the type sold by PPG Industries, Inc. under its registered trademark NESA or the surfaces 41 and 43 may be the "tin side" of glass panes cut from a glass ribbon made by the float process, i.e. the side of a glass ribbon floating on a tin or tin alloy bath as taught in U.S. Pat. No. 4,091,156.

Although the invention is taught using NESA coated glass or having the tin side of the glass facing the airspace, it can now be appreciated that the invention is not limited thereto. For example, any coating that is not effected by moisture may be applied to the glass sheet and act as a protective layer. The features of Multiple-Glazed Unit Design No. 1 may be used with the features of Multiple-Glazed Unit Design No. 2. More particularly, a multiple-glazed unit having breather holes 42 located substantially directly opposite each other may use glass panes having a protective coating on the interior surface of the glass panes. Further, the glass panes having the protective surface can be used with a multiple-glazed unit having one (see FIG. 4) or more holes in the spacing and sealing assembly and one hole need not be directly opposite another hole. This is because the protective coating protects the interior surface of the glass panes in those instances where there is no direct moisture-vapor molecular transmission path provided by having substantially directly opposite openings as discussed for the Multiple-Glazed Unit Design No. 1.

Multiple-Glazed Unit Design No. 3

Figure 5:
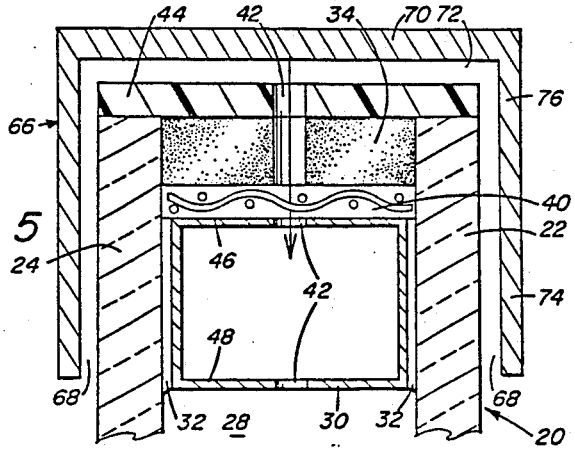
FIG. 5 is a fragmentary, cross-sectional view of the composite sash and window unit of FIG. 6, discussed below, taken along the line V—V in FIG. 6.
Figure 6:
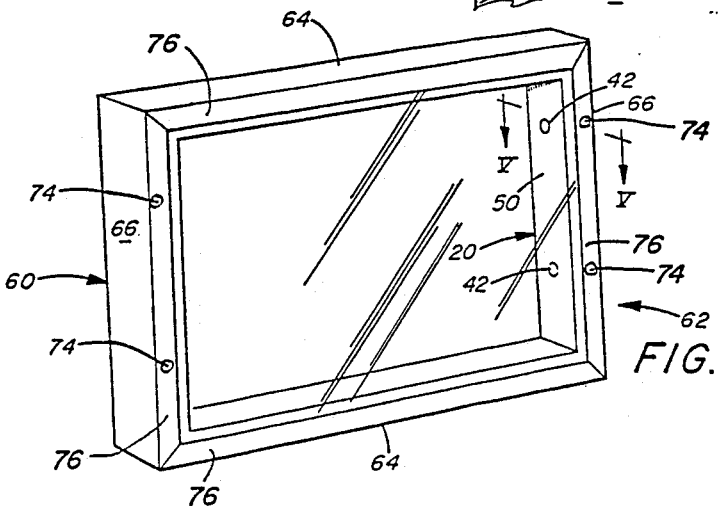
FIG. 6 is a perspective view of the window unit of FIG. 1 installed within a sash embodying further features of the present invention.

Multiple-Glazed Unit Design No. 3, in general, relates to mounting a multiple-glazed unit in a sash. Referring now to FIG. 6, there can be seen a window unit 20 having units of the type taught in Multiple-Glazed Unit Design Nos. 1 and 2, a sash 60 to retain the units to facilitate installation of the composite window and sash 62 into a window opening (not shown) whereat the unit is to be installed. The type of sash 60 used is not limiting to the present invention as any convenient frame means may be employed, e.g. a wood or metal frame, e.g. of the type taught in U.S. Pat. No. 3,932,971 issued to Day, which teachings are herein incorporated by reference. The window unit 20 comprises breather holes 42 through opposite corner portions of the vertical legs 50 of the spacer and sealant assembly 26, as shown in FIG. 1. The sash 60 comprises horizontal sash members 64 and vertical sash members 66 joined at their ends so as to form an enclosure or frame conforming to the perimetrical shape of the window unit 20. Referring additionally to FIG. 5, each of the sash members 64 and 66 has a longitudinally extending channel recess or glazing pocket 68 sized to receive and capture the corresponding edges of the window unit 20. In order to ensure a snug fit and to environmentally seal the glazing pockets 68, a resilient, e.g. rubber, neoprene, or silicone gasket (not shown), weatherstripping (not shown), caulking (not shown), or the like, is preferably applied in a convenient manner, as is widely known and practiced in the pertinent art, between the inside walls of the glazing pockets 68 and the outer marginal edge surfaces of the glass sheets 22, 24, around the entire periphery thereof. Intermittent setting blocks (not shown) may be provided within the glazing pocket 68 of the lower horizontal sash member 64 to support the window unit 20 in a vertical position within the sash 60, in the normal manner, as is already well known in the pertinent art. In accordance with the present invention, the base 70 of the glazing pockets 68 of at least the vertical sash members 66 are spaced from the outer surface of the corresponding vertical legs 50 of the spacer and sealant assembly 26 of the window unit 20, to provide a longitudinally extending vertical air passageway channel or chamber 72 between the base 70 of the glazing pockets 68 of the vertical sash members 66 and the outer surface of the corresponding vertical legs 50 of the spacer and sealant assembly 26. Further, one or more openings 74 are provided through the outer face or wall 76 of the vertical sash members 66 to put the chambers 72 in direct communication with the ambient atmosphere around the composite window and sash 62. Therefore, since the chambers 72 communicate with the airspace 28 via the breather holes 42, the openings 74 serve to communicate the airspace 28 with the ambient atmosphere, thereby enabling rapid equalization of the pressure and relative humidity of the airspace 28 and the ambient atmosphere. In order to maximize air and water vapor molecular flow through the airspace 28, the atmosphere communicating openings 74 are preferably located in close proximity to the location of the corresponding breather holes 42 through the corresponding legs of the spacer and sealant assembly 26. Most preferably, the openings 74 are disposed substantially horizontally adjacent to their corresponding breather holes 42. More particularly, with reference to FIG. 6, if the breather holes 42 are provided through opposite corner portions of the vertical legs 50 of the spacer and sealant assembly 26, then the atmosphere communicating openings 74 are preferably provided through corresponding opposite corner portions of the outer face or wall 76 of the vertical sash members 66, to maximize air and water vapor molecular flow through the insulating airspace 28. Similarly, if the breather holes 42 are provided through opposite corner portions of the horizontal legs 52 of the spacer and sealant assembly 26, then the atmosphere communicating openings 74 are preferably provided through corresponding opposite corner portions of the outer face or wall 76 of the horizontal sash members 64. In the latter instance, the base 70 of the glazing pockets 68 of the horizontal sash members 64 must be spaced from the outer surface of the corresponding horizontal legs 52 of the spacer and sealant assembly 26 to provide a longitudinally extending air passageway channel or chamber (not shown) between the base 70 of the glazing pockets 68 of the horizontal sash members 64 and the outer surface of the corresponding horizontal legs 52 of the spacer and sealant assembly 26. It should be clearly understood that the size, shape, location, type, and/or configuration of the openings 74 are not limiting to the present invention. The openings 74 may suitably be, e.g. slits, slots, apertures, or holes of any shape, e.g. oval, circular, elliptical, triangular, rectangular, polygonal, etc.

Referring still to FIG. 6, the openings 74 are preferably shielded from the external environment by means of a suitable water or weather barrier means, e.g. generally arcuate or canopy-shaped members (not shown) which are conveniently attached, e.g. mechanically fastened or welded, to the outer face or wall of the sash members 64 and/or 66 with which the openings 74 are associated. The canopy-shaped members are preferably disposed in spaced, shielding relation to at least a portion of their associated openings 74, to minimize infiltration of liquid water and the like through the openings 74, by minimizing the amount of water allowed to reach the openings 74. Further, a fine mesh screen (not shown) made of any suitable material, e.g. mylar, fabric, or metal, is preferably provided in direct covering relation to the holes 74 to function as a filtering medium to further minimize ingress of liquid water, dirt, dust, etc. through the openings 74 into the vertical chambers 72 and/or the horizontal chambers (not shown).

Multiple-Glazed Unit Design No. 4

The Multiple-Glazed Design Unit No. 4 has the interior surfaces of the glass panes protected as taught for Multiple-Glazed Design Unit No. 2; has the spacing and sealing assembly as taught for Multiple-Glazed Design Unit Nos. 1 and 2 except there are no breather holes or openings, and uses the sash taught in Multiple-Glazed Design Unit No. 3 except there are no holes. Stated more simply, the units of Multiple-Glazed Design Unit No. 4 have a sealed airspace, no desiccant or adsorbent material in the spacing and sealing assembly, and a protective coating on the interior surface of the glass sheets or panes.

DETAILED DESCRIPTION OF TEST EMBODIMENTS OF THE PRESENT INVENTION

The development of the present invention will be discussed to provide an appreciation of the invention.

Units similar to the type taught in U.S. Pat. No. 3,609,293 were constructed and mounted in a commercial building for evaluation. Approximately ten (10) years after installation, the units were checked to determine the durability of the electroconductive coating on the surface of the sheet facing the airspace. The units measured a frost Point of +50° F. (10° C.). Units having a +50° F. (10° C.) or greater frost point are considered to be failed units. An inventor of the instant invention noted that there was no scum on the interior surfaces of the glass sheets.

The inventors conducted the following experiments to determine why there was no scum on the interior coated and uncoated surfaces of the glass sheets.

Twenty-four multiple-glazed units were constructed. The units were of the same basic construction as the multiple-glazed units sold by PPG Industries, Inc. under its registered trademark TWINDOW®. In general and with reference to the drawings for ease of discussion, each unit had a pair of glass sheets 22, 24 separated by about a ⅜ inch (0.95 centimeter) metal spacer. The units had a length of about 20 inches (50.8 centimeters), a width of about 14 inches (0.64 centimeters) and a thickness of ⅝ inch (1.59 centimeters).

Four groups of six units were made. Three units of each group were made having the air side of the glass sheets facing the airspace, and the other three units had the surfaces of the glass sheets facing the airspace coated with a pyrolytic tin oxide coating sold by PPG Industries, Inc. under its registered trademark NESA. The NESA coating had about a 400 ohm resistance.

Group I had no desiccant in the metal spacer. Group II was similar to Group I except a hole having a diameter of about 1/16 inch (0.16 centimeters) was provided in the back wall of a spacer leg at the midpoint. 3M Company No. 394 venting tape was used to cover the hole. A 0.040 inch (0.10 centimeter) thick, 1 inch long and 0.350 inch (0.89 centimeter) wide section of metal clip was utilized to cover the hole. The clip having a ⅛ inch (0.32 centimeter) diameter hole aligned with the hole in the spacer was secured in position by Fuller 1081A hot melt. The holes were cleared to provide communication between the airspace and atmosphere. Group III was similar to Group I except the spacer was filled with silica gel wetted by water (10 grams of silica gel to 1.2 grams of water). Group IV was similar to Group I except the spacer was filled with molecular sieve wetted by water (10 grams of molecular sieve, 2.3 grams of water).

The frost point of each unit was measured using a brass container mounted in an insulating sleeve. Dry ice and acetone were added to the cup. The container was positioned in the center of the unit and acetone added to the container. Dry ice was added to the acetone to bring the solution to temperatures at which frost is expected to appear on the inside glass surface. The container was held in position for at least five minutes. A thermometer positioned in the solution recorded the temperature at which frost appeared on the inside glass surface after a five minute hold time.

The units of Groups I and II each had a frost point of about +50° F. (10° C.); the units of Group III had a frost point between +26° to 28° F. (−3.3° to −2.2° C.) and the units of Group IV had a frost point between +34° to 38° F. (1° to 3° C.). The airspaces were provided with moisture as indicated by their frost point, to determine if moisture would cause scum on the glass surface and/or show frost inside the unit with low outside temperatures.

Each of the units was placed in a sealed chamber and exposed to temperatures between 0° F. (−17° C.) and −30° F. (−34° C.) for 16 or more hours and thereafter checked for internal frost. None of the units showed appreciable frost at 0° F. ("17° C.); however at −30° F. (−34° C.) all the units except those of Group III showed some frost with no appreciable difference between the coated and uncoated glass sheets. It was concluded that none of the twenty-four units would show frost if glazed in a building where the outside temperature was −30° F. (−34° C.) or higher.

Each of the units was then subjected to a P-1 test of ASTM E6 P3. The observations of the units after the P-1 test are listed in Table 1.

TABLE 1

| Group | Unit No. | Glass Surface Facing Airspace | Observations |
|---|---|---|---|
| I | 1–3 | clear | Two of the units had scum and stain on the interior glass surface and loss of adhesion of the hot melt; one unit had no visual change. |
| I | 4–6 | protected | Two units had no visual changes; one unit had water in the airspace but no stain on the interior glass surfaces. |
| II | 7–9 | clear | All units had broken seals; two units had heavy scum and |

TABLE 1-continued

| Group | Unit No. | Glass Surface Facing Airspace | Observations |
|---|---|---|---|
| | | | stains, and one unit had moderate scum and stain, on the interior glass surfaces. |
| II | 10–12 | protected | No visual change. |
| II | 13–15 | clear | Units tested for only two weeks. All units had water in the airspace. No scum or haze on the interior glass surfaces. |
| III | 16–18 | protected | Same observations as for Units 13–15. |
| IV | 19–21 | clear | All units had broken seals; two units had no visual change; one had severe scum on interior glass surfaces. |
| IV | 22–24 | protected | One unit broke; two had no change; no broken seals. |

The following test was conducted to determine the durability of NESA coating in a wet environment. Nine units of the type similar to the units of Group II were constructed having 6- inch (15.24 centimeter) sides. Three units were made having the air side of the clear glass facing the airspace, three units having the tin side facing the airspace; three units having a 500 ohm NESA coating on the glass surface facing the airspace.

The units were exposed at 140° F. (60° C.) high humidity for the time periods shown in Table 2. The results of the test are listed in Table 2. The transmission and haze were measured using a Hunter Model D554 haze meter.

TABLE 2

| Units | Glass Surface Facing Airspace | Weeks: Initial A | Initial B | 1 A | 1 B | 2 A | 2 B | 11 A | 11 B | 14 A | 14 B |
|---|---|---|---|---|---|---|---|---|---|---|---|
| 25–27 | Air side | 82.8 | 1.4 | 77.7 | 24.6 | 477.7 | 28.7 | — | — | — | — |
| 28–30 | Tin side | 82.8 | 1.4 | 82.7 | 2.8 | 82.8 | 2.9 | 82.9 | 4.4 | — | — |
| 31–33 | NESA 500 ohm coating | 64.5 | 1.5 | 65.3 | 1.8 | 65.5 | 2.8 | 65.5 | 2.4 | 65.7 | 2.5 |

A is the % transmission value
B is the % haze value

Tests for units 25–27 were discontinued after two weeks, and for units 28–30 after 11 weeks because the haze readings were too high.

It was concluded from the results of this test that a unit having a hole in the spacer, no desiccant in the spacing and sealing assembly, and a protective layer on the interior glass surface would perform better than a unit having a similar construction but having an unprotected interior glass surface.

The following test was conducted to determine why there was no scum on the interior uncoated glass surfaces of the field units, and to determine if the position and number of holes in the spacer and sealing assembly could eliminate or minimize the haze and/or prevent loss of transmission of units having a construction similar to the units 25–27.

Six units, units 34–39, had a construction similar to units 25 –27 with the following exception. Unit 34 was a unit from units 25–27 that had one breather hole through the midpoint of one of the legs of the spacing and sealing assembly thereof; unit 35 had one breather hole through each of two adjacent legs of the spacing and sealing assembly thereof; unit 36 had a breather hole through each of two opposite legs; unit 37 had holes in each of three adjacent legs of the spacing and sealing assembly thereof; unit 38 had a breather hole through each of two opposite legs of the spacing and sealing assembly thereof. The unit 39 was similar to unit 38 and had a 3M Y-394 venting tape covering the holes. Units 34–39 were exposed at 140° F. (60° C.) high humidity for one week and the haze and transmission measured using a Hunter Model D554 haze meter. The results are shown in following Table 3.

TABLE 3

| Unit | Hole Location in 4-Sided Spacer and Sealing Assembly | % Transmission | % Haze |
|---|---|---|---|
| 34 | one hole in one side | 77.7 | 24.6 |
| 35 | one hole in two adjacent sides | 79.2 | 17.7 |
| 36 | one hole in one pair of opposite sides | 82.2 | 10.4 |
| 37 | one hole in three sides | 78.2 | 21.6 |
| 38 | one hole in each side | 82.3 | 1.8 |
| 39 | one hole in each side with 3M venting tape covering the holes | 81.3 | 2.4 |

From the above it was concluded that units having a construction similar to units 38 and 39, i.e. a unit having one hole in each of 4 sides and having no desiccant had acceptable performance.

In the following evaluation units were fabricated for field testing. With reference to FIGS. 1, 5 and 6, twenty-nine window units 20 having breather holes 42 through opposite corner portions of the vertical legs 50 of the spacer and sealant assembly 26 were built. The glass sheets 22, 24 each comprised a sheet of float glass having the tin side thereof facing the insulating airspace 28. The insulating airspace 28 was ½ inch (1/27 cm.) thick. The window units 20 were of the same basic construction as the multi-glazed window units sold by PPG Industries, Inc. under their registered trademark TWINDOW®, except that the metal spacer 30 contained no desiccant or adsorbent material, i.e. it was hollow. Thirteen units had vertical legs 50 about two (2) feet (70.5 cm.) long and horizontal legs 52 about four (4) feet (122.5 cm.) long; four units with horizontal legs about 21 inches long, 48 inches long; eight units were about 25 inches horizontal, 48 inches long and four units were 23 inches horizontal by 48 inches long. The breather holes 42 were about ⅛ inch (0.32 cm.) in diameter and located approximately one (1) inch (2.54 cm.) from the corners of the vertical legs 50. The moisture-resistant mastic layer 32 comprised an adhesive sealant layer of the type taught in U.S. Pat. No. 3,791,910. The fine mesh screen 40 used to cover the breather holes 42 was a venting tape sold by 3M Company under its trademark Y394 Venting Tape® which was held in fixed relation to the spacer 30 by a silicone-based adhesive sealant sold by General Electric under their trademark GE 320®. The sealant layer 34 comprised a bead of GE 3204 sealant applied around the outer periphery of the unit at the glass to spacer junction to form, in effect, a continuous glue cleat, to maintain the spacer in position between the sheets 22, 24.

The atmosphere-communicating openings 74 were located about one inch (2.54 cm.) from the opposite corners of the vertical sash members 66. The vertical air chamber 72 and the horizontal air chamber (not shown) were about ¼ inch (0.64 cm.) in width, i.e. a clearance of approximately ¼ inch (0.64 cm.) was provided between the base 70 of the glazing pockets 68 and the outer peripheral surfaces of the spacer and sealant assembly 26 around the entire periphery thereof. The openings 74 were circular and had a diameter of about ⅜ inch (0.95 cm.). The openings 74 were covered by a fine mesh stainless steel screen (not shown). In addition, the thirteen units each had weather shielding provided by canopy-shaped members (not shown) secured to the outer face of the vertical sash members 66 in space, covering relation to the openings 74. The units were installed in various locations in western Pennsylvania. The units have been on test for more than four years. The windows as of August 1988 have not displayed any visible fog, haze, condensation, scum, stain, or the like.

Although the present invention has been described in some detail with regard to some embodiments thereof, it should be clearly understood that the present invention is not limited thereto, and that many variations and/or modifications may appear to those in the art without departing from the spirit and scope of the invention. For example, the breather holes 42 may be located in an almost infinite number of locations or configurations, depending upon the size of the unit 20, the thickness of the airspace 28, and the size and shape of the holes 42, amongst a host of other variable parameters. The holes 42 may be, e.g. located right through the corners of the unit; at the midpoint of the legs of the spacer and sealant assembly; 2½ inches (6.35 cm.) from the corners, or in any other position which enables free movement of air and water vapor molecules through the airspace 28. Similarly, the location, size, and configuration of the atmosphere-communicating openings provided through the sash members may be varied in a virtually endless number of ways. The scope of this invention should be determined solely on the basis of the following claims.

We claim:

1. A multiple-glazed unit, comprising:

a pair of sheets;

spacing and sealing means having a pair of opposed horizontal legs and a pair of opposed vertical legs joined at their ends positioned between said pair of sheets for maintaining said sheets in space relation to each other and defining a sealed insulating airspace between said sheets; and a plurality of openings provided through said spacing and sealing means to put said insulating airspace in direct communication with atmosphere external to the unit to thereby allow the air pressure within said airspace and the air pressure of said external atmosphere to equalize wherein said openings are sized and configured such as to cooperatively function to minimize haze formation within said airspace and to maintain haze level within said airspace below a threshold level of about 7% haze as measured with a Hunter Model D554 instrument, after the unit is subjected to about one week exposure at about 140° F. (66° C.), 90% relative humidity, in a controlled testing environment.

2. The unit as set forth in claim 1, wherein said spacing and sealing means contains substantially no desiccant or dehydrator material.

3. The unit as set forth in claim 2, wherein said spacing and sealing means comprises:

a spacer element bonded to the opposed marginal edge portions of said sheets;

an adhesive sealant layer disposed around the periphery of said spacer element in sealing engagement with the opposed marginal edge portions of said sheets, wherein said adhesive sealant layer forms a resilient, adhesive, structural bond with said sheets to maintain said sheets at a desired spacing; and said openings each comprise aligned openings provided completely through said sealant layer and said spacer element.

4. The unit as set forth in claim 3, wherein said openings cooperatively function to provide a direct, unobstructed, moisture-vapor molecular free flow path between said airspace and said external atmosphere.

5. The unit as set forth in claim 1, further comprising filtering means disposed in covering relation to said openings for minimizing ingress of liquid water, dust, dirt, or the like through said openings into said airspace.

6. The unit as set forth in claim 3, wherein said openings include at least one opening provided through each said leg of at least one of said pairs of opposed legs of said spacing and sealing means.

7. The unit as set forth in claim 1, wherein said openings include an opening through opposite corner portions of each of said vertical legs of said spacing and sealing means.

8. The unit as set forth in claim 1, wherein said openings include an opening through opposite corner portions of each of said horizontal legs of said spacing and sealing means.

9. The unit as set forth in claim 1, wherein said openings include an opening through a central portion of each of said horizontal legs and each of said vertical legs of said spacing and sealing means.

10. The unit as set forth in claim 7, wherein each of said openings has a cross-sectional area of between about 0.05 sq. inches (0.31416 sq. cm.) and about 0.00077 sq. inches (0.005 sq. cm.).

11. The unit as set forth in claim 1, wherein said threshold haze level is 5% haze as measured with a Hunter D554 instrument, after the unit is subjected to about one week exposure at about 140° F (60° C.), 90% relative humidity.

12. The unit as set forth in claim 7, wherein said openings provided through said opposite corner portions of a one of said vertical legs are disposed substantially directly opposite corner portions of the other one of said vertical legs, respectively.

13. The unit as set forth in claim 1, wherein the surfaces of the glass sheets facing the airspace have a protective coating.

14. The unit as set forth in claim 13, wherein the protective surface is a pyrolytic tin oxide coating on said surface of the glass sheets facing the airspace.

15. The unit as set forth in claim 13, wherein the sheets are cut from a glass piece floated on a metal bath and the surface of the glass piece contacting the bath is the surface of the glass facing the airspace.

16. The unit as set forth in claim 3, further comprising a frame means for retaining the unit within a structural opening, wherein said frame comprises:

a pair of horizontal sash members and a pair of vertical sash members joined at their ends to form a frame disposed in circumscribing relation to said spacing and sealing means, wherein each of said sash members comprises a longitudinally extending glazing pocket adapted to receive and retain the sealed edges of said assembly led sheets, wherein the base of said glazing pocket of at least said sash members corresponding to said legs of said spacing and sealing means provided with said at least one opening, is spaced from the outer surface of said aforesaid legs to provide longitudinally extending air passageway chambers between the outer surface of at least said legs of said spacing and sealing means provided with said at least one opening and the base of said glazing pocket of the corresponding sash members; and at least one opening provided through each said sash member of at least one pair of opposed sash members to put said air passageway chambers in direct communication with the external atmosphere.

17. The unit as set forth in claim 16, wherein said openings provided through said sash members cooperatively function to permit the free movement of air and water vapor molecules from the external atmosphere through said air passageway chambers, said openings provided through said legs of said spacing a"d- sealing means and said insulating airspace, and back into the external atmosphere.

18. The unit as set forth in claim 17, wherein said openings provided through said sash members are located substantially adjacent to said openings provided through said legs of said spacing and sealing means.

19. The unit as set forth in claim 1 wherein the threshold level is below about 4%.

* * * * *

UNITED STATES PATENT AND TRADEMARK OFFICE

CERTIFICATE OF CORRECTION

PATENT NO. : 4,952,430

DATED : August 28, 1990

INVENTOR(S) : George H. Bowser and Stanley J. Pyzewski

It is certified that error appears in the above-identified patent and that said Letters Patent is hereby corrected as shown below:

Column 15, Claim 16, line 10, delete "assembly led" and insert --assembled--.

Column 16, Claim 17, line 6, delete "a"d-" and insert --and--.

Signed and Sealed this

Third Day of March, 1992

*Attest:*

HARRY F. MANBECK, JR.

*Attesting Officer*

*Commissioner of Patents and Trademarks*